US008224657B2

(12) United States Patent
Jelinek et al.

(10) Patent No.: US 8,224,657 B2
(45) Date of Patent: Jul. 17, 2012

(54) METHOD AND DEVICE FOR EFFICIENT IN-BAND DIM-AND-BURST SIGNALING AND HALF-RATE MAX OPERATION IN VARIABLE BIT-RATE WIDEBAND SPEECH CODING FOR CDMA WIRELESS SYSTEMS

(75) Inventors: Milan Jelinek, Sherbrooke (CA); Redwan Salami, Ville St-Laurent (CA)

(73) Assignee: Nokia Corporation, Espoo (FI)

( * ) Notice: Subject to any disclaimer, the term of this patent is extended or adjusted under 35 U.S.C. 154(b) by 1116 days.

(21) Appl. No.: 10/520,374

(22) PCT Filed: Jun. 27, 2003

(86) PCT No.: PCT/CA03/00980

§ 371 (c)(1),
(2), (4) Date: Sep. 12, 2005

(87) PCT Pub. No.: WO2004/006226

PCT Pub. Date: Jan. 15, 2004

(65) Prior Publication Data

US 2006/0100859 A1 May 11, 2006

(51) Int. Cl.
*G10L 19/00* (2006.01)
*G10L 21/04* (2006.01)

(52) U.S. Cl. ..... 704/500; 704/501; 704/502; 704/503

(58) Field of Classification Search ..... 704/201, 704/208, 214, 219, 226, 500–503; 455/427, 455/446, 455; 370/476, 468
See application file for complete search history.

(56) References Cited

U.S. PATENT DOCUMENTS 5,444,816 A 8/1995 Adoul et al. ..... 395/2.28
(Continued)

FOREIGN PATENT DOCUMENTS

EP 0 492 459 A2 7/1992
(Continued)

OTHER PUBLICATIONS

Garg, "IS-95 CDMA and cdma2000", published by Prentice Hall, PTR, 2000.*
(Continued)

*Primary Examiner* — Jialong He
(74) *Attorney, Agent, or Firm* — Harrington & Smith

(57) ABSTRACT

In the method and device for interoperating a first station using a first communication scheme and comprising a first coder and a first decoder with a second station using a second communication scheme and comprising a second coder and a second decoder, communication between the first and second stations is conducted by transmitting signal-coding parameters related to a sound signal from the coder of one of the first and second stations to the decoder of the other station. The sound signal is classified to determine whether the signal-coding parameters should be transmitted from the coder of one station to the decoder of the other station using a first communication mode in which full bit rate is used for transmission of the signal-coding parameters. When classification of the sound signal determines that the signal-coding parameters should be transmitted using the first communication mode and when a request to transmit the signal-coding parameters from the coder of one station to the decoder of the other station using a second communication mode designed to reduce bit rate during transmission of the signal-coding parameters is received, a portion of the signal-coding parameters from the coder one station is dropped and the remaining signal-coding parameters are transmitting to the decoder of the other station using the second communication mode. The dropped portion of the signal-coding parameters are regenerated before the decoder of the other station decodes the signal-coding parameters.

18 Claims, 8 Drawing Sheets

U.S. PATENT DOCUMENTS

| | | | | |
|---|---|---|---|---|
| 5,504,773 | A * | 4/1996 | Padovani et al. | 375/130 |
| 5,519,779 | A * | 5/1996 | Proctor et al. | 380/34 |
| 5,657,420 | A * | 8/1997 | Jacobs et al. | 704/223 |
| 5,699,482 | A | 12/1997 | Adoul et al. | 395/2.28 |
| 5,701,392 | A | 12/1997 | Adoul et al. | 395/2.28 |
| 5,754,976 | A | 5/1998 | Adoul et al. | 704/223 |
| 6,014,621 | A * | 1/2000 | Chen | 704/220 |
| 6,182,030 | B1 * | 1/2001 | Hagen et al. | 704/201 |
| 6,308,222 | B1 * | 10/2001 | Krueger et al. | 709/247 |
| 6,330,534 | B1 * | 12/2001 | Yasunaga et al. | 704/223 |
| 6,539,237 | B1 * | 3/2003 | Sayers et al. | 455/555 |
| 6,604,070 | B1 * | 8/2003 | Gao et al. | 704/222 |
| 6,766,289 | B2 * | 7/2004 | Kandhadai et al. | 704/207 |
| 6,885,638 | B2 * | 4/2005 | Xu et al. | 370/230 |
| 7,010,001 | B2 * | 3/2006 | Odenwalder | 370/476 |
| 7,426,466 | B2 | 9/2008 | Ananthapadmanabhan et al. | 704/230 |
| 2001/0018650 | A1 * | 8/2001 | DeJaco | 704/200.1 |
| 2001/0027391 | A1 * | 10/2001 | Yasunaga et al. | 704/223 |
| 2002/0006138 | A1 * | 1/2002 | Odenwalder | 370/468 |
| 2002/0101844 | A1 * | 8/2002 | El-Maleh et al. | 370/342 |
| 2002/0111799 | A1 * | 8/2002 | Bernard | 704/220 |
| 2003/0012137 | A1 | 1/2003 | Abdelilah et al. | 370/229 |
| 2003/0046066 | A1 * | 3/2003 | Kandhadai et al. | 704/216 |
| 2003/0065508 | A1 * | 4/2003 | Tsuchinaga et al. | 704/215 |
| 2003/0186694 | A1 * | 10/2003 | Sayers et al. | 455/426.1 |
| 2003/0208715 | A1 * | 11/2003 | Morgan et al. | 714/776 |

FOREIGN PATENT DOCUMENTS

| | | | |
|---|---|---|---|
| EP | 1035538 | A2 | 9/2000 |
| JP | 8146997 | A | 6/1996 |
| JP | 10512415 | | 11/1998 |
| JP | 2000-081898 | A1 | 3/2000 |
| JP | 2001-267085 | | 9/2001 |
| JP | 2003525473 | | 8/2003 |
| JP | 2003532149 | | 10/2003 |
| WO | WO-96/22639 | A1 | 7/1996 |
| WO | WO 00/25305 | | 5/2000 |
| WO | WO 00/48170 | | 8/2000 |
| WO | WO-01/03391 | A1 | 1/2001 |
| WO | WO-01/22402 | A1 | 3/2001 |
| WO | WO 01/52467 | | 7/2001 |
| WO | WO 01/65544 | A1 | 9/2001 |
| WO | WO-01/78430 | A1 | 10/2001 |
| WO | WO 01/82293 | A1 | 11/2001 |
| WO | WO-02/03601 | A1 | 1/2002 |

OTHER PUBLICATIONS

Zeng et al. "Harmonization of Global Third-Generation Mobile Systems", IEEE Communications Magazine, Dec. 2000.*

"Wideband coding of speech at around 16 kbit/s using Adaptive Multi-rate Wideband (AMR-WB)", ITU-T, G.722.2, Jul. 2003, pp. 1-74.

"Coding of Speech At 8 kbit/s Using Conjugate-Structure Algebraic-Code-Excited Linear-Prediction (CS-ACELP)", ITU-T Recommendation G.729, Mar. 1996, 20 pages.

"3rd Generation Partnership Project; Technical Specification Group Services and System Aspects; Speech codec speech processing functions; Adaptive Multi-Rate—Wideband (AMR-WB) speech codec; Transcoding functions (Release 6)", 3GPP TS 26.190 V6.1.1, Jul. 2005, pp. 1-83.

"Signal Modification for Voiced Wideband Speech Coding and Its Application for IS-95 System", Mikko Tommi et al., IEEE 2002, pp. 35-37.

"Celp Coding at Variable Rate", Luca Cellario et al., XP000470681, vol. 5, No. 5, Sep.-Oct. 1994, Milano, Italy, 11 pages.

* cited by examiner

BEGIN
201
VOICE ACTIVITY DETECTED?
NO
YES
202
STABLE UNVOICED FRAME?
YES
NO
203
STABLE VOICED FRAME?
YES
NO
311
LOW ENERGY FRAME?
YES
NO
311
HR SYSTEM REQUEST?
YES
NO
208
EIGHTH-RATE (CNG)
207
HALF-RATE UNVOICED
206
HALF-RATE VOICED
312
GENERIC HALF-RATE
205
FULL-RATE
CODING AND QUANTIZATION

METHOD AND DEVICE FOR EFFICIENT IN-BAND DIM-AND-BURST SIGNALING AND HALF-RATE MAX OPERATION IN VARIABLE BIT-RATE WIDEBAND SPEECH CODING FOR CDMA WIRELESS SYSTEMS

CROSS REFERENCE TO RELATED APPLICATIONS

This patent application is a 371 of and claims priority from International Patent Application No. PCT/CA2003/000980, filed Jun. 27, 2003 (PCT Publication No. WO 2004/006226 A1), which claims priority to Canadian Patent Application No. 2,392,640, filed Jul. 5, 2002.

FIELD OF THE INVENTION

The present invention relates to a method for interoperating a first station using a first communication scheme and comprising a first coder and a first decoder with a second station using a second communication scheme and comprising a second coder and a second decoder, wherein communication between the first and second stations is conducted by transmitting signal-coding parameters from the coder of one of the first and second stations to the decoder of the other of said first and second stations.

BACKGROUND OF THE INVENTION

Demand for efficient digital narrowband and wideband speech coding techniques with a good trade-off between the subjective quality and bit rate is increasing in various application areas such as teleconferencing, multimedia, and wireless communications. Until recently, telephone bandwidth constrained into a range of 200-3400 Hz has mainly been used in speech coding applications. However, wideband speech applications provide increased intelligibility and naturalness in communication compared to the conventional telephone bandwidth. A bandwidth in the range 50-7000 Hz has been found sufficient for delivering a good quality giving an impression of face-to-face communication. For general audio signals, this bandwidth gives an acceptable subjective quality, but is still lower than the quality of FM radio or CD that operate on ranges of 20-16000 Hz and 20-20000 Hz, respectively.

A speech coder converts a speech signal into a digital bit stream which is transmitted over a communication channel or stored in a storage medium. The speech signal is digitized, that is, sampled and quantized with usually 16-bits per sample. The speech coder has the role of representing these digital samples with a smaller number of bits while maintaining a good subjective quality of speech. The speech decoder or synthesizer operates on the transmitted or stored bit stream and converts it back to a speech signal.

Code-Excited Linear Prediction (CELP) coding is one of the best prior art techniques for achieving a good compromise between the subjective quality and bit rate. This coding technique constitutes the basis of several speech coding standards both in wireless and wire line applications. In CELP coding, the sampled speech signal is processed in successive blocks of N samples usually called frames, where N is a predetermined number corresponding typically to 10-30 ms. A linear prediction (LP) filter is computed and transmitted every frame. The computation of the LP filter typically needs a look-ahead, i.e. a 5-15 ms speech segment from the subsequent frame. The N-sample frame is divided into smaller blocks called subframes. Usually the number of subframes in a frame is three (3) or four (4) resulting in 4-10 ms subframes. In each subframe, an excitation signal is usually obtained from two components, the past excitation and the innovative, fixed-codebook excitation. The component formed from the past excitation is often referred to as the adaptive codebook or pitch excitation. The parameters characterizing the excitation signal are coded and transmitted to the decoder, where the reconstructed excitation signal is used as the input of the LP filter.

In wireless systems using Code Division Multiple Access (CDMA) technology, the use of source-controlled Variable Bit Rate (VBR) speech coding significantly improves the capacity of the system. In source-controlled VBR coding, the codec operates at several bit rates, and a rate selection module is used to determine the bit rate used for coding each speech frame based on the nature of the speech frame (e.g. voiced, unvoiced, transient, background noise, etc.). The goal is to attain the best speech quality at a given average bit rate, also referred to as Average Data Rate (ADR). The codec can operate at different modes by tuning the rate selection module to attain different ADRs at the different modes, where codec performance improves with increasing ADRs. This provides the codec with a mechanism of trade-off between speech quality and system capacity. In CDMA systems (e.g. CDMA-one and CDMA2000), typically 4 bit rates are used and they are referred to as Full-Rate (FR), Half-Rate (HR), Quarter-Rate (QR), and Eighth-Rate (ER). In this system two rate sets are supported referred to as Rate Set I and Rate Set II. In Rate Set II, a variable-rate codec with rate selection mechanism operates at source-coding bit rates of 13.3 (FR), 6.2 (HR), 2.7 (QR), and 1.0 (ER) kbit/s, corresponding to gross bit rates of 14.4, 7.2, 3.6, and 1.8 kbit/s (with some bits added for error detection).

In CDMA systems, the half-rate can be imposed instead of full-rate in some speech frames in order to send in-band signaling information (called dim-and-burst signaling). The use of half-rate as a maximum bit rate can be also imposed by the system during bad channel conditions (such as near the cell boundaries) in order to improve the codec robustness. This is referred to as half-rate max. Typically, in VBR coding, the half rate is used when the frame is stationary voiced or stationary unvoiced. Two codec structures are used for each type of signal (in unvoiced case a CELP model without the pitch codebook is used and in voiced case signal modification is used to enhance the periodicity and reduce the number of bits for the pitch indices). Full-rate is used for onsets, transient frames, and mixed voiced frames (a typical CELP model is usually used). When the rate-selection module chooses the frame to be encoded as a full-rate frame and the system imposes the half-rate frame the speech performance is degraded since the half-rate modes are not capable of efficiently encoding onsets and transient signals.

A wideband codec known as Adaptive Multi-Rate Wide-Band (AMR-WB) speech codec was recently selected by the ITU-T (International Telecommunications Union-Telecommunication Standardization Sector) for several wideband speech telephony and services and by 3GPP (Third Generation Partnership Project) for GSM and W-CDMA third generation wireless systems. The AMR-WB codec comprises nine (9) bit rates in the range from 6.6 to 23.85 kbit/s. Designing an AMR-WB-based source controlled VBR codec for CDMA2000 system has the advantage of enabling interoperation between CDMA2000 and other systems using the AMR-WB codec. The AMR-WB bit rate of 12.65 kbit/s is the closest rate that can fit in the 13.3 kbit/s full-rate of Rate Set II. This rate can be used as the common rate between a CDMA2000 wideband VBR codec and AMR-WB to enable interoperability without the need for transcoding (which degrades the speech quality). A half-rate at 6.2 kbit/s has to be added to the CDMA2000 VBR wideband solution to enable the efficient operation in the Rate Set II framework. The codec can then operate in few CDMA2000-specific modes and comprises a mode for enabling interoperability with systems using the AMR-WB codec. However, in a cross-system tandem free operation call between CDMA2000 and another system using AMR-WB, the CDMA2000 system can force the use of the half-rate as explained earlier (such as in dim-and-burst signaling). Since the AMR-WB codec does not recognize the 6.2 kbit/s half-rate of the CDMA2000 wideband codec, forced half-rate frames are interpreted as erased frames. This adversely affects the performance of the connection.

SUMMARY OF THE INVENTION

According to a first aspect of the present invention, there is provided:

A method for interoperating a first station using a first communication scheme and comprising a first coder and a first decoder with a second station using a second communication scheme and comprising a second coder and a second decoder, wherein communication between the first and second stations is conducted by transmitting signal-coding parameters from the coder of one of the first and second stations to the decoder of the other of said first and second stations, this method comprising: receiving a request to transmit the signal-coding parameters from said one station to the other station using a communication mode designed to reduce bit rate during transmission of the signal-coding parameters; in response to the request, dropping a portion of the signal-coding parameters from the coder of said one station and transmitting to the decoder of the other station the remaining signal-coding parameters; and regenerating the portion of the signal-coding parameters and decoding, in the decoder of the other station, the signal-coding parameters.

A system for interoperating a first station using a first communication scheme and comprising a first coder and a first decoder with a second station using a second communication scheme and comprising a second coder and a second decoder, wherein communication between the first and second stations is conducted by transmitting signal-coding parameters from the coder of one of the first and second stations to the decoder of the other of said first and second stations, this system comprising: means for receiving a request to transmit the signal-coding parameters from said one station to the other station using a communication mode designed to reduce bit rate during transmission of the signal-coding parameters; means for dropping, in response to the request, a portion of the signal-coding parameters from the coder of said one station and transmitting to the decoder of the other station the remaining signal-coding parameters; and means for regenerating the portion of the signal-coding parameters and the decoder of the other station for decoding the signal-coding parameters.

According to a second aspect of the present invention, there is provided:

A method for interoperating a first station using a first communication scheme and comprising a first coder and a first decoder with a second station using a second communication scheme and comprising a second coder and a second decoder, wherein communication between the first and second stations is conducted by transmitting signal-coding parameters related to a sound signal from the coder of one of the first and second stations to the decoder of the other of the first and second stations, this method comprising: classifying the sound signal to determine whether the signal-coding parameters should be transmitted from the coder of said one station to the decoder of the other station using a first communication mode in which full bit rate is used for transmission of the signal-coding parameters; receiving a request to transmit the signal-coding parameters from the coder of said one station to the decoder of the other station using a second communication mode designed to reduce bit rate during transmission of the signal-coding parameters; when classification of the sound signal determines that the signal-coding parameters should be transmitted using the first communication mode, and when the request to transmit the signal-coding parameters using the second communication mode is received, dropping a portion of the signal-coding parameters from the coder of said one station and transmitting to the decoder of the other station the remaining signal-coding parameters using the second communication mode.

A system for interoperating a first station using a first communication scheme and comprising a first coder and a first decoder with a second station using a second communication scheme and comprising a second coder and a second decoder, wherein communication between the first and second stations is conducted by transmitting signal-coding parameters related to a sound signal from the coder of one of the first and second stations to the decoder of the other of the first and second stations, this system comprising: means for classifying the sound signal to determine whether the signal-coding parameters should be transmitted from the coder of said one station to the decoder of the other station using a first communication mode in which full bit rate is used for transmission of the signal-coding parameters; means for receiving a request to transmit the signal-coding parameters from the coder of said one station to the decoder of the other station using a second communication mode designed to reduce bit rate during transmission of the signal-coding parameters; means for dropping, when classification of the sound signal determines that the signal-coding parameters should be transmitted using the first communication mode and when the request to transmit the signal-coding parameters using the second communication mode is received, a portion of the signal-coding parameters from the coder of said one station and transmitting to the decoder of the other station the remaining signal-coding parameters using the second communication mode.

According to a third aspect of the present invention, there is provided:

A method for transmitting signal-coding parameters from a first station to a second station, comprising: in one of the first and second stations, coding the sound signal in accordance with a full-rate communication mode; receiving a request to transmit the signal-coding parameters from said one station to the other station of the first and second stations using a second communication mode designed to reduce bit rate during transmission of the signal-coding parameters; in response to the request, converting the signal-coding parameters coded in full-rate communication mode to signal-coding parameters coded in the second communication mode; and transmitting the signal-coding parameters coded in the second communication mode to the other of the first and second stations.

A system for transmitting signal-coding parameters from a first station to a second station, comprising: in one of the first and second stations, a coder for coding the sound signal in accordance with a full-rate communication mode; means for receiving a request to transmit the signal-coding parameters from said one station to the other station of the first and second stations using a second communication mode designed to reduce bit rate during transmission of the signal-coding parameters; means for converting, in response to the request, the signal-coding parameters coded in full-rate communication mode to signal-coding parameters coded in the second communication mode; and means for transmitting the signal-coding parameters coded in the second communication mode to the other of the first and second stations.

The foregoing and other objects, advantages and features of the present invention will become more apparent upon reading of the following non-restrictive description of illustrative embodiments thereof, given by way of example only with reference to the accompanying drawings.

DETAILED DESCRIPTION OF THE ILLUSTRATIVE EMBODIMENT

Although the illustrative embodiment of the present invention will be described in the following description in relation to a speech signal, it should be kept in mind that the concepts of the present invention equally apply to other types of signal, in particular but not exclusively to other types of sound signals.

Figure 1:
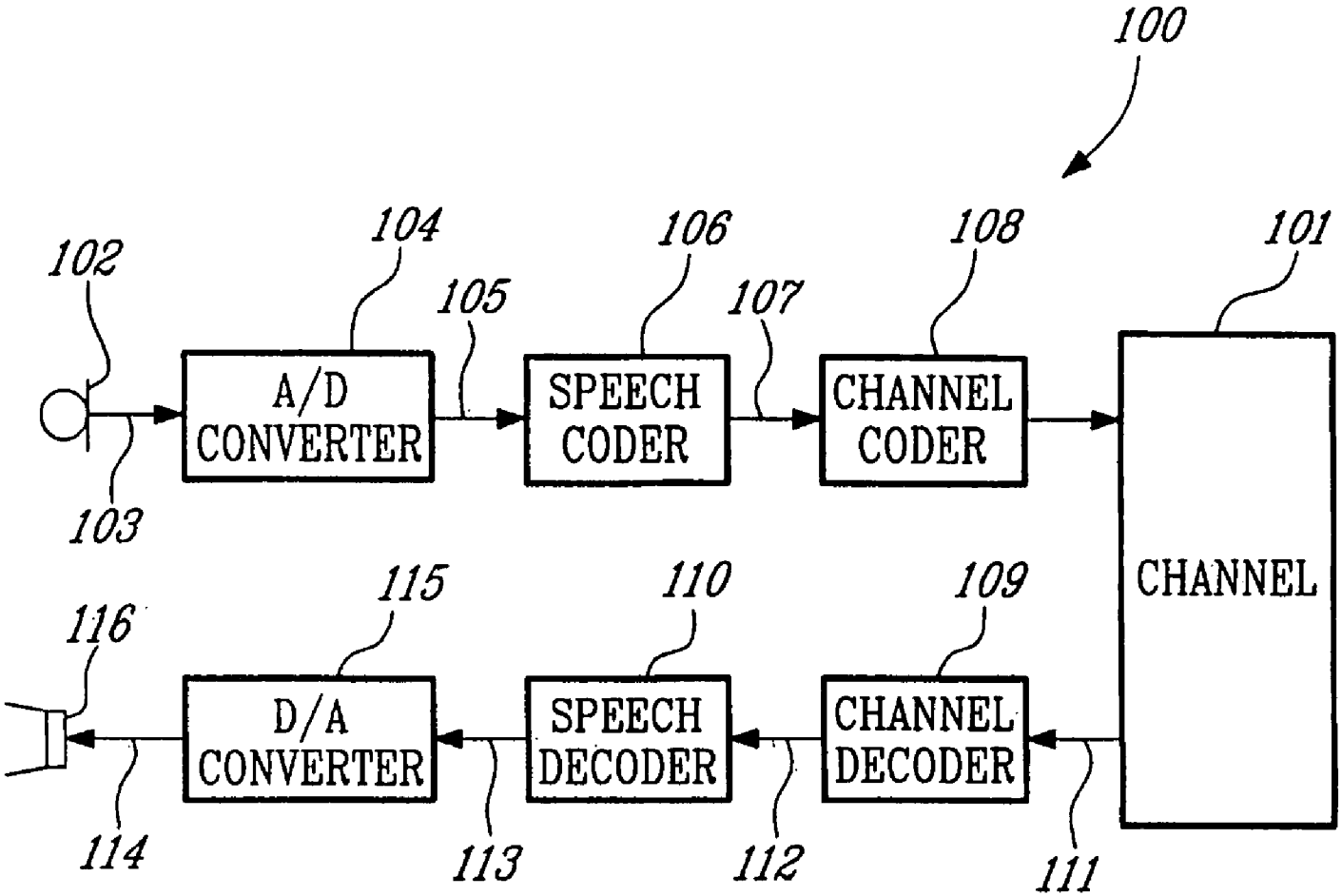
FIG. 1 is a schematic block diagram of a non-restrictive example of speech communication system in which the present invention can be used.

FIG. 1 illustrates a speech communication system 100 depicting the use of speech encoding and decoding devices. The speech communication system 100 of FIG. 1 supports transmission of a speech signal across a communication channel 101. Although it may comprise for example a wire, an optical link or a fiber link, the communication channel 101 typically comprises at least in part a radio frequency link. The radio frequency link often supports multiple, simultaneous speech communications requiring shared bandwidth resources such as may be found with cellular telephony systems. Although not shown, the communication channel 101 may be replaced by a storage device in a single device implementation of the system 100 that records and stores the encoded speech signal for later playback.

In the speech communication system 100 of FIG. 1, a microphone 102 produces an analog speech signal 103 that is supplied to an analog-to-digital (A/D) converter 104 for converting it into a digital speech signal 105. A speech coder 106 codes the digital speech signal 105 to produce a set of signal-coding parameters 107 that are coded into binary form and delivered to a channel coder 108. The optional channel coder 108 adds redundancy to the binary representation of the signal-coding parameters 107 before transmitting them over the communication channel 101.

In the receiver, a channel decoder 109 utilizes the redundant information in the received bit stream 111 to detect and correct channel errors that occurred during the transmission. A speech decoder 110 converts the bit stream 112 received from the channel decoder 109 back to a set of signal-coding parameters and creates from the recovered signal-coding parameters a digital synthesized speech signal 113. The digital synthesized speech signal 113 reconstructed at the speech decoder 110 is converted to an analog form 114 by a digital-to-analog (D/A) converter 115 and played back through a loudspeaker unit 116.

Source-Controlled Variable Bit Rate Speech Coding

Figure 2:
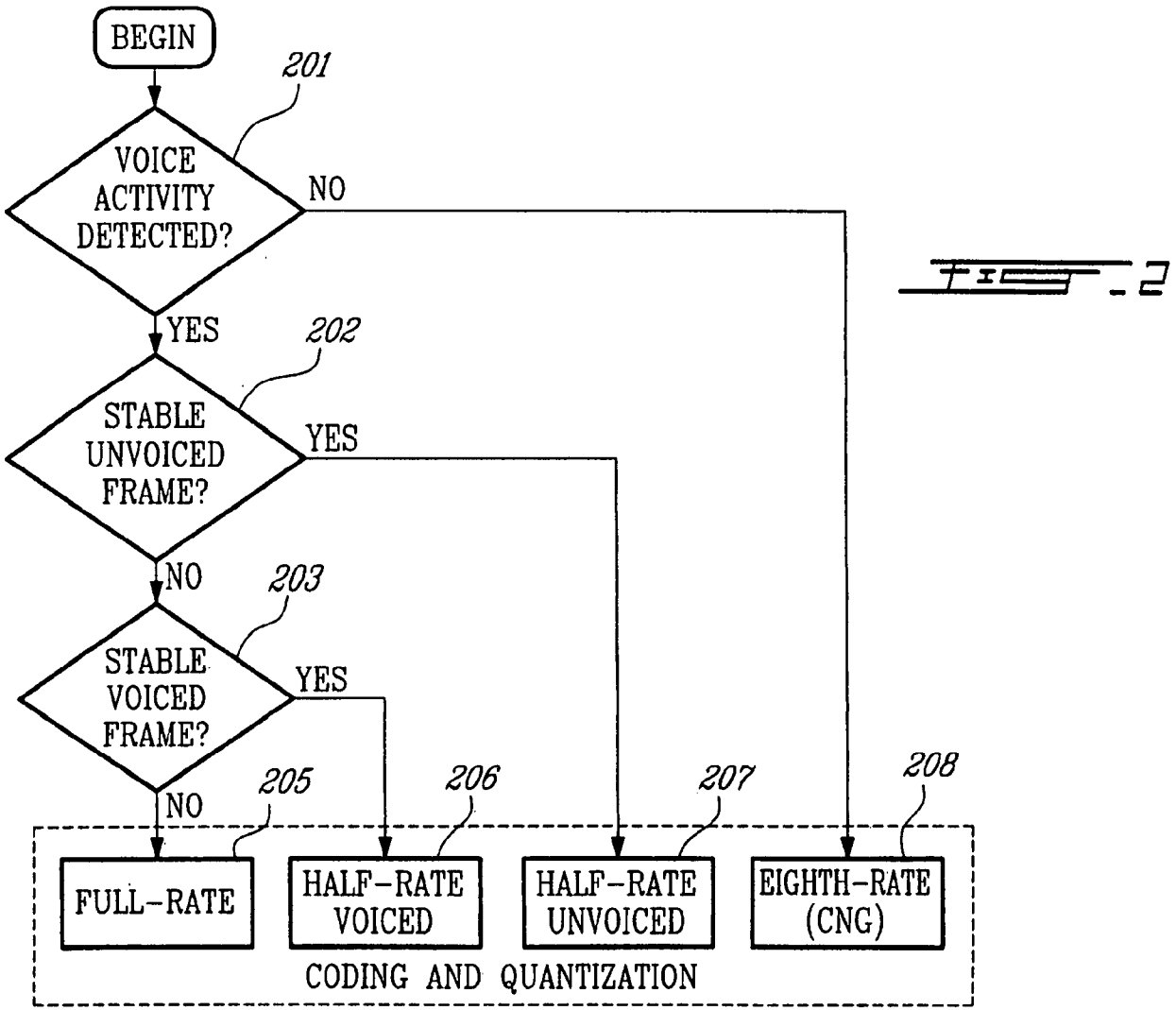
FIG. 2 is a functional block diagram of a non-restrictive example of variable bit rate codec, comprising a rate determination logic.

FIG. 2 depicts a non-restrictive example of variable bit rate codec configuration including a rate determination logic for controlling four coding bit rates. In this example, the set of bit rates comprises a dedicated codec bit rate for non-active speech frames (Eighth-Rate (CNG) coding module 208), a bit rate for unvoiced speech frames (Half-Rate Unvoiced coding module 207), a bit rate for stable voiced frames (Half-Rate Voiced coding module 206), and a bit rate for other types of frames (Full-Rate coding module 205).

The rate determination logic is based on signal classification performed in three steps (201, 202, and 203) on a frame basis, whose operation is well known to those of ordinary skill in the art.

First, a Voice Activity Detector (VAD) 201 discriminates between active and inactive speech frames. If an inactive speech frame is detected (background noise signal) then the signal classification chain ends and the frame is coded in coding module 208 as an eighth-rate frame with comfort noise generation (CNG) at the decoder (1.0 kbit/s according to CDMA2000 Rate Set II). If an active speech frame is detected, the frame is subjected to a second classifier 202.

The second classifier 202 is dedicated to making a voicing decision. If the classifier 202 classifies the frame as an unvoiced speech frame, the classification chain ends, and the frame is coded in module 207 with a half-rate optimized for unvoiced signals (6.2 kbit/s according to CDMA2000 Rate Set II). Otherwise, the speech frame is processed through the "stable voiced" classifier 203.

If the frame is classified as a stable voiced frame, then the frame is coded in module 206 with a half-rate optimized for stable voiced signals (6.2 kbit/s according to CDMA2000

Rate Set II). Otherwise, the frame is likely to contain a non-stationary speech segment such as a voiced onset or rapidly evolving voiced speech signal. These frames typically require a high bit rate for sustaining good subjective quality. Thus, in this case, the speech frame is coded in module 205 as a full-rate frame (13.3 kbit/s according to CDMA2000 Rate Set II).

Figure 3:
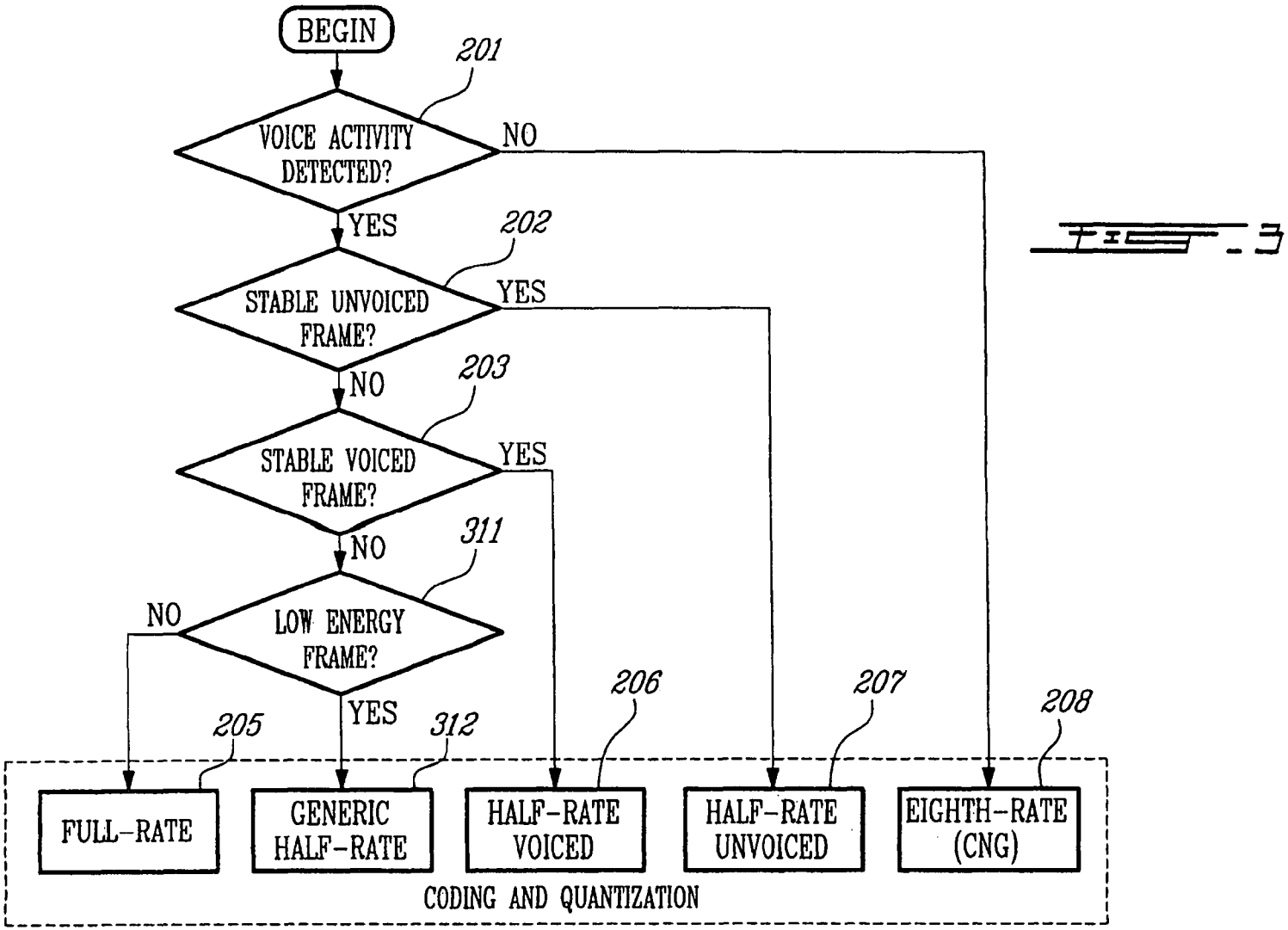
FIG. 3 is a functional block diagram of a non-restrictive example of variable bit rate codec including a rate determination logic using Generic HR for low energy frames.

In a non-restrictive alternative implementation shown in FIG. 3, if the frame is not classified as "stable voiced", it is processed through a low energy frame classifier 311. This is used to detect frames not taken into account by the VAD detector 201. If the frame energy is below a certain threshold the frame is encoded using a Generic Half-Rate coder 312, otherwise the frame is coded in module 205 as a full-rate frame.

The signal classifying modules 201, 202, 203 and 311 are well-known to those of ordinary skill in the art and, accordingly, will not be further described in the present specification. In the non-restrictive example of FIG. 3, the coding modules at different bit rates, namely modules 205, 206, 207, 208 and 312 are based on Code-Excited Linear Prediction (CELP) coding techniques, also well known to those of ordinary skill in the art. For example, the bit rates are set according to Rate Set II of the CDMA2000 system described herein above.

The non-restrictive, illustrative embodiment of the present invention is described herein with reference to a wideband speech codec that has been standardized by the International Telecommunications Union (ITU) as Recommendation G.722.2 and known as the AMR-WB codec (Adaptive Multi-Rate WideBand codec) [ITU-T Recommendation G.722.2 "Wideband coding of speech at around 16 kbit/s using Adaptive Multi-Rate Wideband (AMR-WB)", Geneva, 2002]. This codec has also been selected by the Third Generation Partnership Project (3GPP) for wideband telephony in third generation wireless systems [3GPP TS 26.190, "AMR Wideband Speech Codec: Transcoding Functions," 3GPP Technical Specification]. AMR-WB can operate at 9 bit rates from 6.6 to 23.85 kbit/s. Here, the bit rate of 12.65 kbit/s is used as an example of full rate.

Of course, the non-restrictive, illustrative embodiment of the present invention could be applied to other types of codecs.

For the sake of reader's convenience, an overview of the AMR-WB codec is given hereinbelow.

Overview of the AMR-WB Coder.

Figure 7:
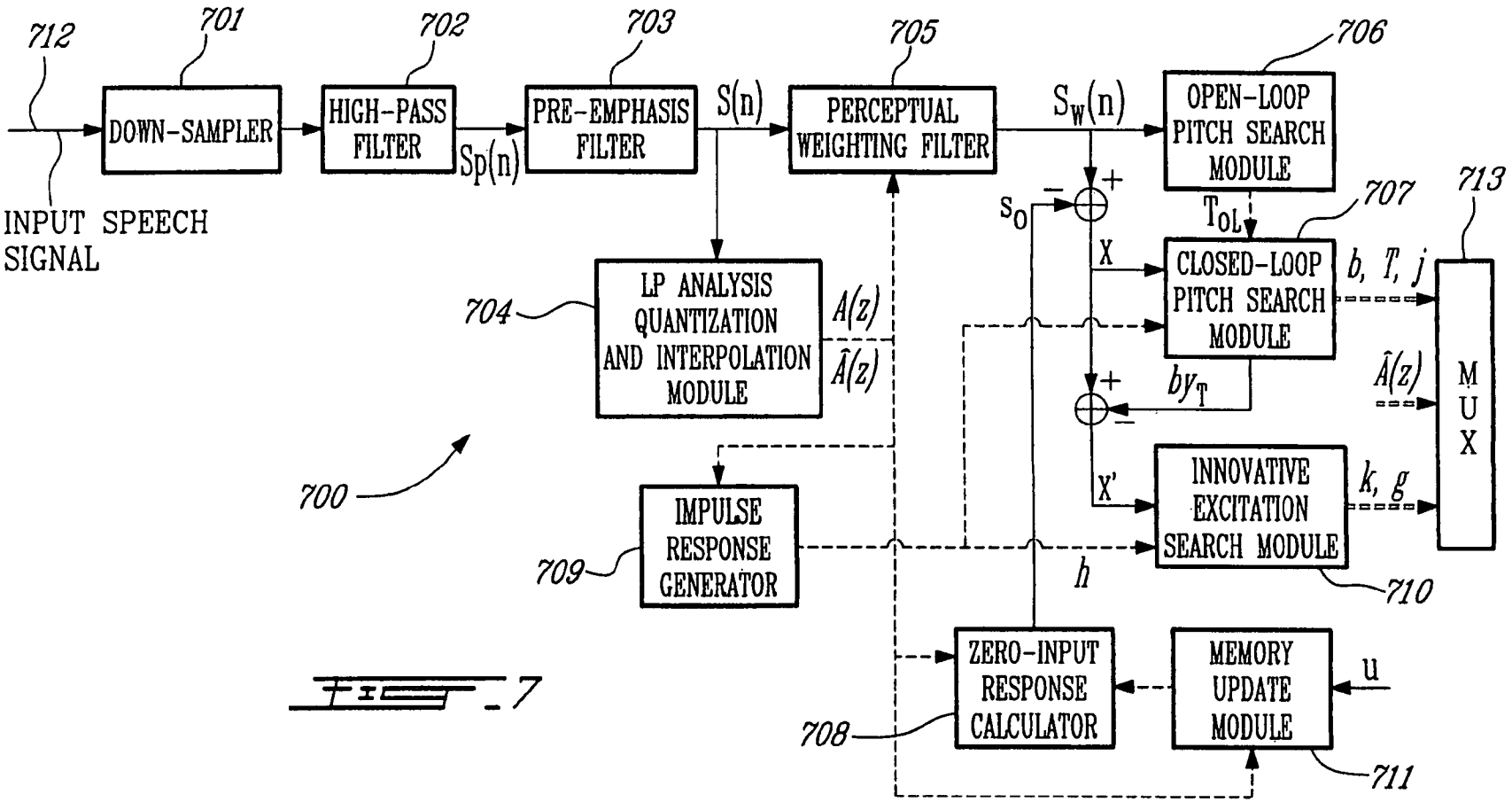
FIG. 7 is a schematic block diagram of a non-restrictive example of wideband coding device, more specifically an AMR-WB coder.

Referring to FIG. 7, the sampled speech signal is encoded on a block by block basis by the coding device 700 of FIG. 7 which is broken down into eleven modules numbered from 701 to 711.

The input speech signal 712 is therefore processed on a block by block basis, i.e. in the above mentioned L-sample blocks called frames.

Referring to FIG. 7, the sampled input speech signal 712 is down-sampled in a down-sampler module 701. The signal is down-sampled from 16 kHz down to 12.8 kHz, using techniques well known to those of ordinary skilled in the art. Down-sampling increases the coding efficiency, since a smaller frequency bandwidth is coded. This also reduces the algorithmic complexity since the number of samples in a frame is decreased. After down-sampling, the 320-sample frame of 20 ms is reduced to a 256-sample frame (down-sampling ratio of 4/5).

The input frame is then supplied to the optional pre-processing module 702. Pre-processing module 702 may consist of a high-pass filter with a 50 Hz cut-off frequency. High-pass filter 702 removes the unwanted sound components below 50 Hz.

The down-sampled, pre-processed signal is denoted by $s_p(n)$, n=0, 1, 2, . . . , L−1, where L is the length of the frame (256 at a sampling frequency of 12.8 kHz). This signal $s_p(n)$ is pre-emphasized using a pre-emphasis filter 703 having the following transfer function:

$$P(z)=1-\mu z^{-1}$$

where μ is a pre-emphasis factor with a value located between 0 and 1 (a typical value is μ=0.7). The function of the pre-emphasis filter 703 is to enhance the high frequency contents of the input speech signal. It also reduces the dynamic range of the input speech signal, which renders it more suitable for fixed-point implementation. Pre-emphasis also plays an important role in achieving a proper overall perceptual weighting of the quantization error, which contributes to improved sound quality.

The output of the pre-emphasis filter 703 is denoted s(n). This signal is used for performing LP analysis in module 704. LP analysis is a technique well known to those of ordinary skill in the art. In the example of FIG. 7, the autocorrelation approach is used. In the autocorrelation approach, the signal s(n) is first windowed using, typically, a Hamming window having a length of the order of 30-40 ms. The autocorrelations are computed from the windowed signal, and Levinson-Durbin recursion is used to compute LP filter coefficients, $a_i$, where i=1, . . . , p, and where p is the LP order, which is typically 16 in wideband coding. The parameters $a_i$ are the coefficients of the transfer function A(z) of the LP filter, which is given by the following relation:

$$A(z) = 1 + \sum_{i=1}^{p} a_i z^{-i}$$

LP analysis is performed in module 704, which also performs the quantization and interpolation of the LP filter coefficients. The LP filter coefficients are first transformed into another equivalent domain more suitable for quantization and interpolation purposes. The Line Spectral Pair (LSP) and Immitance Spectral Pair (ISP) domains are two domains in which quantization and interpolation can be efficiently performed. The 16 LP filter coefficients, $a_i$, can be quantized with a number of bits of the order of 30 to 50 bits using split or multi-stage quantization, or a combination thereof. The purpose of the interpolation is to enable updating of the LP filter coefficients every subframe while transmitting them once every frame, which improves the coder performance without increasing the bit rate. Quantization and interpolation of the LP filter coefficients is believed to be otherwise well known to those of ordinary skill in the art and, accordingly, will not be further described in the present specification.

The following paragraphs will describe the rest of the coding operations performed on a subframe basis. The input frame is divided into 4 subframes of 5 ms (64 samples at the sampling frequency of 12.8 kHz). In the following description, the filter A(z) denotes the unquantized interpolated LP filter of the subframe, and the filter $\hat{A}(z)$ denotes the quantized interpolated LP filter of the subframe. The filter $\hat{A}(z)$ is supplied every subframe to a multiplexer 713 for transmission through a communication channel.

In analysis-by-synthesis coders, the optimum pitch and innovation parameters are searched by minimizing the mean squared error between the input speech signal 712 and a synthesized speech signal in a perceptually weighted domain. The weighted signal $s_w(n)$ is computed in a perceptual weighting filter 705 in response to the signal s(n) from the pre-emphasis filter 703. A perceptual weighting filter 705 with fixed denominator, suited for wideband signals, is used. An example of transfer function for the perceptual weighting filter 705 is given by the following relation:

$$W(z)=A(z/y_1)/(1-y_2z^{-1}) \text{ where } 0y_2<y_1\leqq 1$$

In order to simplify the pitch analysis, an open-loop pitch lag $T_{OL}$ is first estimated in an open-loop pitch search module 706 from the weighted speech signal $s_w(n)$. Then the closed-loop pitch analysis, which is performed in a closed-loop pitch search module 707 on a subframe basis, is restricted around the open-loop pitch lag $T_{OL}$ which significantly reduces the search complexity of the LTP parameters T (pitch lag) and b (pitch gain). The open-loop pitch analysis is usually performed in module 706 once every 10 ms (two subframes) using techniques well known to those of ordinary skill in the art.

The target vector x for LTP (Long Term Prediction) analysis is first computed. This is usually done by subtracting the zero-input response $s_0$ of weighted synthesis filter $W(z)/\hat{A}(z)$ from the weighted speech signal $s_w(n)$. This zero-input response $s_0$ is calculated by a zero-input response calculator 708 in response to the quantized interpolation LP filter $\hat{A}(z)$ from the LP analysis, quantization and interpolation module 704 and to the initial states of the weighted synthesis filter $W(z)/\hat{A}(z)$ stored in memory update module 711 in response to the LP filters A(z) and $\hat{A}(z)$, and the excitation vector u. This operation is well known to those of ordinary skill in the art and, accordingly, will not be further described.

A N-dimensional impulse response vector h of the weighted synthesis filter $W(z)/\hat{A}(z)$ is computed in the impulse response generator 709 using the coefficients of the LP filter A(z) and $\hat{A}(z)$ from module 704. Again, this operation is well known to those of ordinary skill in the art and, accordingly, will not be further described in the present specification.

The closed-loop pitch (or pitch codebook) parameters b, T and j are computed in the closed-loop pitch search module 707, which uses the target vector x, the impulse response vector h and the open-loop pitch lag $T_{OL}$ as inputs.

The pitch search consists of finding the best pitch lag T and gain b that minimize a mean squared weighted pitch prediction error, for example $$e^{(j)} = \|x - b^{(j)}y^{(j)}\|^2 \text{ where } j = 1, 2, \ldots, k$$

between the target vector x and a scaled filtered version of the past excitation by.

More specifically, the pitch (pitch codebook) search is composed of three stages.

In the first stage, an open-loop pitch lag $T_{OL}$ is estimated in the open-loop pitch search module 706 in response to the weighted speech signal $s_w(n)$. As indicated in the foregoing description, this open-loop pitch analysis is usually performed once every 10 ms (two subframes) using techniques well known to those of ordinary skill in the art.

In the second stage, a search criterion C is searched in the closed-loop pitch search module 707 for integer pitch lags around the estimated open-loop pitch lag $T_{OL}$ (usually ±5), which significantly simplifies the search procedure. A simple procedure is used for updating the filtered codevector $y_T$ (this vector is defined in the following description) without the need to compute the convolution for every pitch lag. An example of search criterion C is given by:

$$C = \frac{x^t y_T}{\sqrt{y_T^t y_T}} \text{ where } t \text{ denotes vector transpose}$$

Once an optimum integer pitch lag is found in the second stage, a third stage of the search (module 707) tests, by means of the search criterion C, the fractions around that optimum integer pitch lag. For example, the AMR-WB standard uses ¼ and ½ subsample resolution.

In wideband signals, the harmonic structure exists only up to a certain frequency, depending on the speech segment. Thus, in order to achieve efficient representation of the pitch contribution in voiced segments of a wideband speech signal, flexibility is needed to vary the amount of periodicity over the wideband spectrum. This is achieved by processing the pitch codevector through a plurality of frequency shaping filters (for example low-pass or band-pass filters). And the frequency shaping filter that minimizes the above defined mean-squared weighted error $e^{(j)}$ is selected. The selected frequency shaping filter is identified by an index j.

The pitch codebook index T is encoded and transmitted to the multiplexer 713 for transmission through a communication channel. The pitch gain b is quantized and transmitted to the multiplexer 713. An extra bit is used to encode the index j, this extra bit being also supplied to the multiplexer 713.

Once the pitch, or LTP (Long Term Prediction) parameters b, T, and j are determined, the next step consists of searching for the optimum innovative excitation by means of the innovative excitation search module 710 of FIG. 7. First, the target vector x is updated by subtracting the LTP contribution:

$$x'=x-by_T$$

where b is the pitch gain and $y_T$ is the filtered pitch codebook vector (the past excitation at delay T filtered with the selected frequency shaping filter (index j) filter and convolved with the impulse response h).

The innovative excitation search procedure in CELP is performed in an innovation codebook to find the optimum excitation codevector $c_k$ and gain g which minimize the mean-squared error E between the target vector x' and a scaled filtered version of the codevector $c_k$, for example:

$$E=\|x'-gHc_k\|^2$$

where H is a lower triangular convolution matrix derived from the impulse response vector h. The index k of the innovation codebook corresponding to the found optimum codevector $c_k$ and the gain g are supplied to the multiplexer 213 for transmission through a communication channel.

It should be noted that the used innovation codebook can be a dynamic codebook consisting of an algebraic codebook followed by an adaptive pre-filter F(z) which enhances given spectral components in order to improve the synthesis speech quality, according to U.S. Pat. No. 5,444,816 granted to Adoul et al. on Aug. 22, 1995. More specifically, the innovative codebook search can be performed in module 710 by means of an algebraic codebook as described in U.S. Pat. Nos. 5,444,816 (Adoul et al.) issued on Aug. 22, 1995; 5,699,482 granted to Adoul et al., on Dec. 17, 1997; 5,754,976 granted to Adoul et al., on May 19, 1998; and 5,701,392 (Adoul et al.) dated Dec. 23, 1997.

Overview of AMR-WB Decoder

Figure 8:
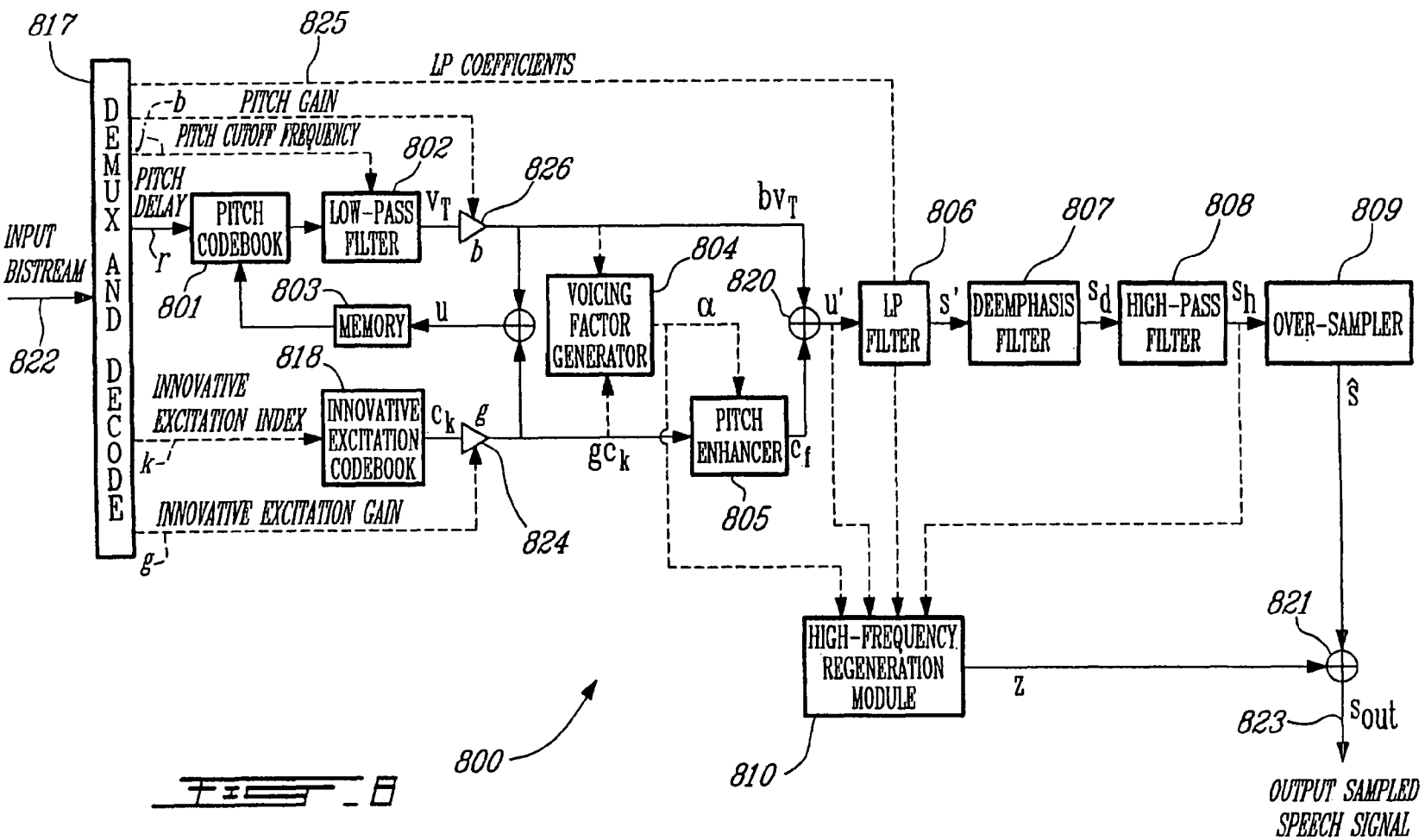
FIG. 8 is a schematic block diagram of a nonrestrictive example of wideband decoding device, more specifically an AMR-WB decoder.

The speech decoder 800 of FIG. 8 illustrates the various steps carded out between the digital input 822 (input bit stream to the demultiplexer 817) and the output sampled speech signal 823 (output of the adder 821).

Demultiplexer 817 extracts the signal-coding parameters from the binary information (input bit stream 822) received from a digital input channel. From each received binary frame, the extracted signal-coding parameters are:

- the quantized, interpolated LP coefficients $\hat{A}(z)$ (line 825) also called short-term prediction parameters (STP) produced once per frame;
- the long-term prediction (LTP) parameters T, b, and j (for each subframe); and
- the innovative excitation index k and gain g (for each subframe).

The current speech signal is synthesized based on these parameters as will be explained hereinbelow.

An innovative excitation codebook 818 is responsive to the index k to produce the innovation codevector $c_k$, which is scaled by the decoded innovative excitation gain g through an amplifier 824. This innovation codebook 818 as described in the above mentioned U.S. Pat. Nos. 5,444,816; 5,699,482; 5,754,976; and 5,701,392 is used to produce the innovation codevector $c_k$.

The generated scaled codevector $gc_k$ at the output of the amplifier 824 is processed through a frequency-dependent pitch enhancer 805.

Enhancing the periodicity of the excitation signal u improves the quality of voiced segments. The periodicity enhancement is achieved by filtering the innovative codevector $c_k$ from the innovative (fixed) excitation codebook through an innovation filter F(z) (pitch enhancer 805) whose frequency response emphasizes the higher frequencies more than the lower frequencies. The coefficients of the innovation filter F(z) are related to the amount of periodicity in the excitation signal u.

An efficient, possible way to derive the coefficients of the innovation filter F(z) is to relate them to the amount of pitch contribution in the total excitation signal u. This results in a frequency response depending on the subframe periodicity, where higher frequencies are more strongly emphasized (stronger overall slope) for higher pitch gains. The innovation filter 805 has the effect of lowering the energy of the innovation codevector $c_k$ at lower frequencies when the excitation signal u is more periodic, which enhances the periodicity of the excitation signal U at lower frequencies more than higher frequencies. A suggested form for the innovation filter 805 is the following:

$$F(z)=-\alpha z+1\alpha z^{-1}$$

where $\alpha$ is a periodicity factor derived from the level of periodicity of the excitation signal u. The periodicity factor $\alpha$ is computed in the voicing factor generator 804. First, a voicing factor $r_v$ is computed in voicing factor generator 804 by:

$$r_v=(E_v-E_c)/(E_v+E_c)$$

where $E_v$ is the energy of the scaled pitch codevector $bv_T$ and $E_c$ is the energy of the scaled innovative codevector $gc_k$. That is:

$$E_v = b^2 v_T^t v_T = b^2 \sum_{n=0}^{N-1} v_T^2(n)$$

and $$E_c = g^2 c_k^t c_k = g^2 \sum_{n=0}^{N-1} c_k^2(n)$$

Note that the value of $r_v$ lies between −1 and 1 (1 corresponds to purely voiced signals and −1 corresponds to purely unvoiced signals).

The above mentioned scaled pitch codevector $bv_T$ is produced by applying the pitch delay T to a pitch codebook 801 to produce a pitch codevector. The pitch codevector is then processed through a low-pass or band-pass filter 802 whose cut-off frequency is selected in relation to index j from the demultiplexer 817 to produce the filtered pitch codevector $v_T$. Then, the filtered pitch codevector $v_T$ is then amplified by the pitch gain b by an amplifier 826 to produce the scaled pitch codevector $bv_T$.

The voicing factor $\alpha$ is then computed in voicing factor generator 804 by:

$$\alpha=0.125(1+r_v)$$

which corresponds to a value of 0 for purely unvoiced signals and 0.25 for purely voiced signals.

The enhanced signal $c_f$ is therefore computed by filtering the scaled innovative codevector $gc_k$ through the innovation filter 805 (F(z)).

The enhanced excitation signal u' is computed by the adder 820 as:

$$u'=c_f+bv_T$$

It should be noted that this process is not performed at the coder 700. Thus, it is essential to update the content of the pitch codebook 801 using the past value of the excitation signal u without enhancement stored in memory 803 to keep synchronism between the coder 700 and decoder 800. Therefore, the excitation signal u is used to update the memory 803 of the pitch codebook 801 and the enhanced excitation signal u' is used at the input of the LP synthesis filter 806.

The synthesized signal s' is computed by filtering the enhanced excitation signal u' through the LP synthesis filter 806 which has the form $1/\hat{A}(z)$, where $\hat{A}(z)$ is the quantized, interpolated LP filter in the current subframe. As can be seen in FIG. 8, the quantized, interpolated LP coefficients $\hat{A}(z)$ on line 825 from the demultiplexer 817 are supplied to the LP synthesis filter 806 to adjust the parameters of the LP synthesis filter 806 accordingly. The de-emphasis filter 807 is the inverse of the pre-emphasis filter 703 of FIG. 7. The transfer function of the de-emphasis filter 807 is given by $$D(z)=1/(1-\mu z^{-1})$$

where $\mu$ is a preemphasis factor with a value located between 0 and 1 (a typical value is $\mu$=0.7). A higher-order filter could also be used.

The vector s' is filtered through the de-emphasis filter D(z) 807 to obtain the vector $s_d$, which is processed through the high-pass filter 808 to remove the unwanted frequencies below 50 Hz and further obtain $s_h$.

The over-sampler 809 conducts the inverse process of the down-sampler 701 of FIG. 7. For example, over-sampling converts the 12.8 kHz sampling rate back to the original 16 kHz sampling rate, using techniques well known to those of ordinary skill in the art. The over-sampled synthesis signal is denoted $\hat{s}$. Signal $\hat{s}$ is also referred to as the synthesized wideband intermediate signal.

The over-sampled synthesis signal $\hat{s}$ does not contain the higher frequency components which were lost during the down-sampling process (module 701 of FIG. 7) at the coder 700. This gives a low-pass perception to the synthesized speech signal. To restore the full band of the original signal, a high frequency generation procedure is performed in module 810 and requires input from voicing factor generator 804 (FIG. 8).

The resulting band-pass filtered noise sequence z from the high frequency generation module 310 is added by the adder 821 to the over-sampled synthesized speech signal $\hat{s}$ to obtain the final reconstructed output speech signal $s_{out}$ on the output 823. An example of high frequency regeneration process is described in International PCT patent application published under No. WO 00/25305 on May 4, 2000.

Referring back to FIG. 3, in full-rate communication mode, a codec according to the AMR-WB standard operates at 12.65 kbit/s and is used with the bit allocation given in Table 1. Use of the 12.65 kbit/s rate of the AMR-WB codec enables the design of a variable bit rate codec for the CDMA2000 system capable of interoperating with other systems using the AMR-WB codec standard. Extra 13 bits are added to fit in the 13.3 kbit/s full-rate of CDMA2000 Rate Set II: These bits are used to improve the codec robustness in the case of erased frames. More details about the AMR-WB codec can be found in the reference "ITU-T Recommendation G.722.2 "Wideband coding of speech at around 16 kbit/s using Adaptive Multi-Rate Wideband (AMR-WB)", Geneva, 2002". The codec is based on the Algebraic Code-Excited Linear Prediction (ACELP) model optimized for wideband signals. It operates on 20 ms speech frames with a sampling frequency of 16 kHz. The LP filter parameters are coded once per frame using 46 bits. Then the frame is divided into four subframes where adaptive and fixed codebook indices and gains are coded once per frame. The fixed codebook is constructed using an algebraic codebook structure where the 64 positions in a subframe are divided into four tracks of interleaved positions and where two signed pulses are placed in each track. The two pulses of each track are encoded using nine bits giving a total of 36 bits per subframe.

TABLE 1

Bit allocation of AMR-WB standard at 12.65 kbit/s (20 ms frames comprising four subframes).

| Parameter | Bits/Frame |
|---|---|
| VAD flag | 1 |
| LP Parameters | 46 |
| Pitch Delay | 30 = 9 + 6 + 9 + 6 |
| Pitch Filtering | 4 = 1 + 1 + 1 + 1 |
| Gains | 28 = 7 + 7 + 7 + 7 |
| Algebraic Codebook | 144 = 36 + 36 + 36 + 36 |
| Total | 253 bits |

Based on AMR-WB at 12.65 kbit/s, the Variable Bit Rate WideBand (VBR-WB) solution can operate according to several communication modes among which one mode is interoperable with AMR-WB at 12.65 kbit/s. Thus two versions of the Full Rate (FR) are used, Interoperable FR where the 13 unused bits are added to obtain 13.3 kbit/s, and Generic or CDMA-specific FR where the VAD bit and the extra 13 available bits are used to transmit information that improves the robustness of the codec against Frame ERasures (FER). The bit allocation of the two FR coding versions is shown in Table 2. It should be pointed out that no extra bits are needed for frame classification information. The 14-bit FER protection contains 6-bit energy information. Therefore, only 63 levels are used to quantize the energy and the last level corresponding to value 63 is reserved to indicate the use of Interoperable mode. Thus, in case of Interoperable FR, the energy information index is set to 63.

TABLE 2

Bit allocation of Generic and Interoperable full-rate CDMA2000 Rate Set II based on the AMR-WB standard at 12.65 kbit/s.

| | Bits per Frame | |
|---|---|---|
| Parameter | Generic FR | Interoperable FR |
| Class Info | — | — |
| VAD bit | — | 1 |
| LP Parameters | 46 | 46 |
| Pitch Delay | 30 | 30 |
| Pitch Filtering | 4 | 4 |
| Gains | 28 | 28 |
| Algebraic Codebook | 144 | 144 |
| FER protection bits | 14 | — |
| Unused bits | — | 13 |
| Total | 266 | 266 |

In case of stable voiced frames, the Half-Rate Voiced coding module 206 is used. The half-rate voiced bit allocation is given in Table 3. Since the frames to be coded in this communication mode are characteristically very periodic, a substantially lower bit rate suffices for sustaining good subjective quality compared for instance to transition frames. Signal modification is used which allows efficient coding of the delay information using only nine bits per 20-ms frame saving a considerable proportion of the bit budget for other signal-coding parameters. In signal modification, the signal is forced to follow a certain pitch contour that can be transmitted with 9 bits per frame. Good performance of long term prediction allows to use only 12 bits per 5-ms subframe for the fixed-codebook excitation without sacrificing the subjective speech quality. The fixed-codebook is an algebraic codebook and comprises two tracks with one pulse each, whereas each track has 32 possible positions.

TABLE 3

Bit allocation of half-rate Generic, Voiced, Unvoiced according to CDMA2000 Rate Set II.

| | Bits per frame | | |
|---|---|---|---|
| Parameter | Generic HR | Voiced HR | Unvoiced HR |
| Class Info | 1 | 3 | 2 |
| VAD bit | — | — | — |
| LP Parameters | 36 | 36 | 46 |
| Pitch Delay | 13 | 9 | — |
| Pitch Filtering | — | 2 | — |
| Gains | 26 | 26 | 24 |
| Algebraic Codebook | 48 | 48 | 52 |
| FER protection bits | — | — | — |
| Unused bits | — | — | — |
| Total | 124 | 124 | 124 |

In case of unvoiced frames, the adaptive codebook (or pitch codebook) is not used. A 13-bit Gaussian codebook is used in each subframe where the codebook gain is encoded with 6 bits per subframe. Note that in cases where the average bit rate needs to be further reduced, unvoiced quarter-rate can be used in case of stable unvoiced frames.

A generic half-rate mode (312) is used for low energy segments as shown in FIG. 3. This generic HR mode can be also used in maximum half-rate operation as will be explained later. The bit allocation of the Generic HR is shown in the above Table 3.

As an example, for classification information for the different HR coders, in case of Generic HR, 1 bit is used to indicate if the frame is Generic HR or other HR. In case of Unvoiced HR, 2 bits are used for classification: the first bit to indicate that the frame is not Generic HR and the second bit to indicate it is Unvoiced HR and not Voiced HR or Interoperable HR (to be explained later). In case of Voiced HR, 3 bits are used: the first 2 bits indicate that the frame is not Generic or Unvoiced HR, and the third bit indicates whether the frame is Unvoiced or Interoperable HR.

The Eighth-Rate (CNG) coding module 208 is used to encode inactive speech frames (silence or background noise). In this case only the LP filter parameters are coded with 14 bits per frame and a gain is encoded with 6 bits per frame. These parameters are used for Comfort Noise Generation (CNG) at the decoder. The bit allocation is indicated in Table 4.

TABLE 4

Bit allocation of the eighth-rate at 1.0 kbit/s for a 20-ms frame.

| Parameter | Bits/Frame |
|---|---|
| LP Parameters | 14 |
| Gain | 6 |
| Total | 20 bits/frame = 1.0 kbit/s |

System-Imposed Half-Rate Operation

According to CDMA coding scheme, the system can impose the use of the half-rate instead of full-rate in some speech frames in order to send in-band signaling information. This is referred to as dim-and-burst signaling. The use of half-rate as a maximum bit rate can be also imposed by the system during bad channel conditions (such as near the cell boundaries) in order to improve the codec robustness. This is referred to as half-rate max. In the VBR coding configuration described above, the half-rate is used when the frame is stationary voiced or stationary unvoiced. Full-rate is used for onsets, transient frames and mixed voiced frames. When the rate-selection module chooses the frame to be encoded as a full-rate frame and the system imposes the half-rate frame the speech performance is degraded since the half-rate communication modes are not capable of efficiently encoding onsets and transient frames.

Furthermore, in a cross-system tandem free operation call between CDMA2000 using the VBR Rate Set II solution based on AMR-WB and another system using the standard AMR-WB, the CDMA2000 system may eventually force the half-rate as explained earlier (such as in dim-and-burst signaling). Since the AMR-WB codec doesn't recognize the 6.2 kbit/s half-rate of the CDMA2000 wideband codec, then forced half-rate frames are interpreted as erased frames. This degrades the performance of the connection.

The non-restrictive illustrative embodiment of the present invention implements a novel technique to improve the performance of variable bit rate speech codecs operating in CDMA wireless systems in situations where the half-rate is imposed by the system. Furthermore, this novel technique improves the performance in case of a cross-system tandem free operation between CDMA2000 and other systems using an AMR-WB codec when the CDMA2000 system forces the use of the half-rate.

In dim-and-burst signaling or half-rate max operation, when the system requests the use of half-rate while a full-rate has been selected by the classification mechanism, this indicates that the frame is not unvoiced nor stable voiced and the frame is likely to contain a non-stationary speech segment such as a voiced onset, or a rapidly evolving voiced speech signal. Thus the use of half-rate optimized for unvoiced or stable voiced signals degrades the speech performance. A new half-rate mode is needed in this case, and a Generic HR has been introduced which can be used in such cases. Thus in case of half-rate max or dim-and-burst operation the coder uses the Generic HR if the frame is not classified as Voiced or Unvoiced HR. However, in CDMA2000 systems, there is an operation known as packet-level signaling whereby the signaling information is not provided to the coder and the system may force the use of HR after the frame has been coded. Thus, if the frame has been coded as FR and the system requires the use of HR then the frame will be declared as erased. Moreover, in case of half-rate max and dim-and-burst operation in the interoperable mode where the VBR coder is interoperating with AMR-WB at 12.65 kbit/s, then the Generic HR cannot be used since it is not part of AMR-WB. To avoid erasing the frame in these situations, (packet-level signaling, or dim-and-burst and half-rate max in the interoperable mode) the non-restrictive illustrative embodiment of the present invention uses a half-rate mode directly derived from the full rate mode by dropping a portion of the signal encoding parameters, for example the fixed codebook indices after the frame has been encoded as a full-rate frame. At the decoder side, the dropped portion of the signal-encoding parameters, for example the fixed codebook indices can be randomly generated and the decoder will operate as if it is in full-rate. This half-rate mode is referred to as Signaling HR or Interoperable HR since both encoding and decoding are performed in full-rate. The bit allocation of the interoperable half-rate mode in accordance with the non-restrictive, illustrative embodiment of the present invention is given in Table 5. In this non-restrictive, illustrative embodiment the full-rate is based on the AMR-WB standard at 12.65 kbit/s, and the half-rate is derived by dropping the 144 bits needed for the indices of the algebraic fixed codebook. The difference between the Signaling HR and Interoperable HR is that the Signaling HR is used in packet-level signaling operation within the CDMA2000 system and FER protection bits can still be used. The Signaling HR is derived directly from the Generic FR shown in Table 1 by dropping the 144 bits for the algebraic codebook indices. Three bits are added for the class information and only six bits are used for FER protection which leaves five unused bits. The Interoperable HR is derived from the Interoperable FR by dropping the 144 bits for the algebraic codebook indices. Three bits are added for the class information which leaves 12 unused bits. As explained earlier when discussing the classification information in case of the different half-rates, three bits are used in case of Voiced HR or Interoperable HR. No extra information is sent to distinguish between Signaling HR and Interoperable HR. Similar to the case of FR, the last level of the 6-bit energy information is used for this purpose. Only 63 levels are used to quantize the energy and the last level corresponding to value 63 is reserved to indicate the use of Interoperable mode. Thus in case of Interoperable HR, the energy information index is set to 63.

TABLE 5

Bit allocation of the Signaling and Interoperable half-rate at 6.2 kbit/s.

| Parameter | Bits per Frame: Signalling HR | Bits per Frame: Interoperable HR |
|---|---|---|
| Class Info | 3 | 3 |
| VAD bit | — | 1 |
| LP Parameters | 46 | 46 |
| Pitch Delay | 30 | 30 |
| Pitch Filtering | 4 | 4 |
| Gains | 28 | 28 |
| Algebraic Codebook | — | — |
| FER protection bits | 8 | — |
| Unused bits | 5 | 12 |
| Total | 124 | 124 |

Figure 4:
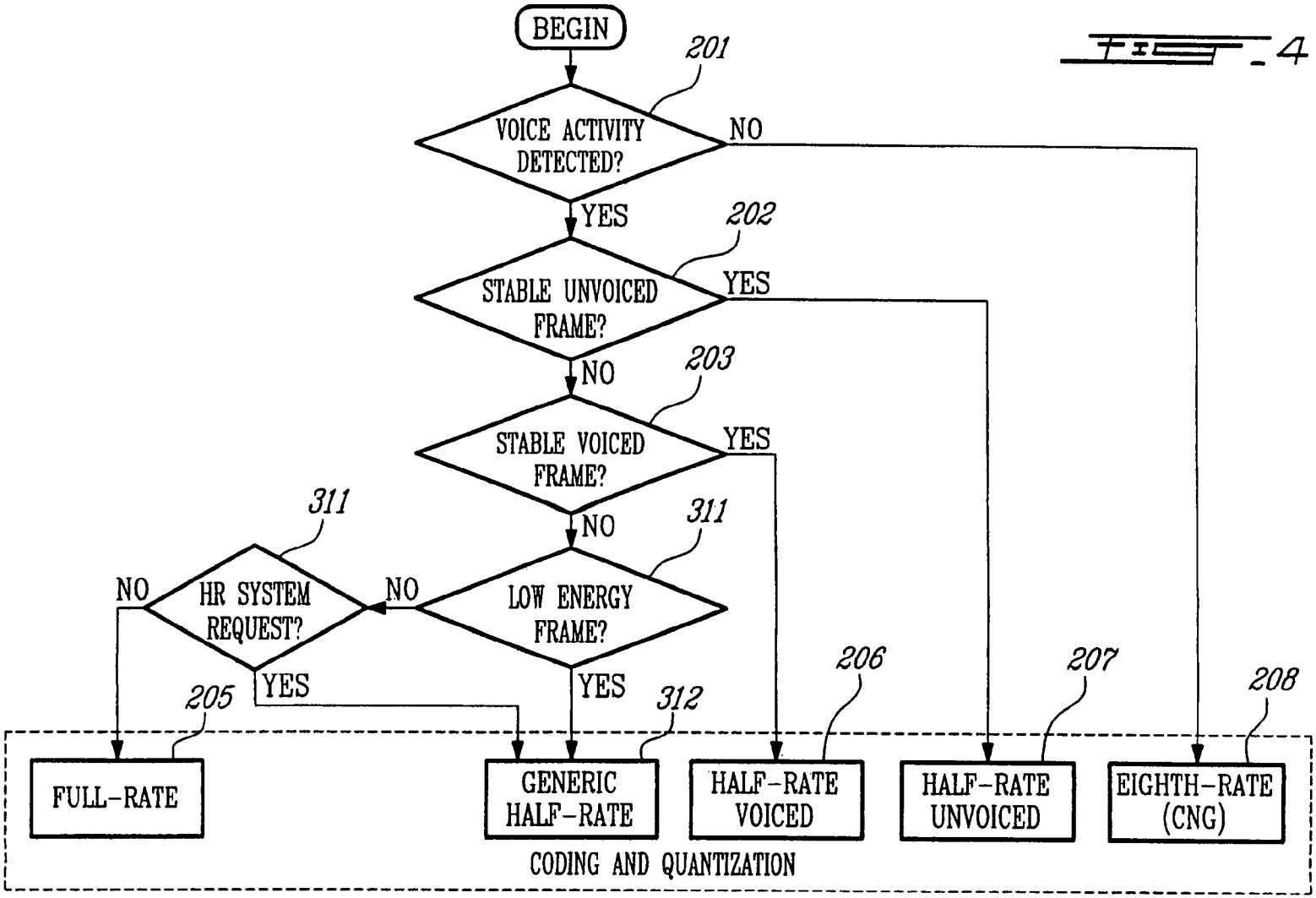
FIG. 4 is the functional block diagram of the non-restrictive example of variable bit rate codec according to FIG. 3, including a half-rate system request within the rate determination logic.

FIG. 4 depicts the functional, schematic block diagram of FIG. 3 by adding the system request for use of half-rate within the rate determination logic. The configuration in FIG. 3 is valid for operation within CDMA2000 system. At the end of the rate determination chain, module 404 verifies if a half-rate system request is present. If the rate determination logic indicates that the frame is an active speech frame (module 201), and it is not unvoiced (module 202) nor stable voiced (module 203) nor frame with low energy (module 311), but the system requests a half-rate operation (module 404), then the Generic half-rate is used to code the frame in module 312.

Otherwise (no half-rate system request is present) the speech frame is encoded in module 205 as a full-rate frame (13.3 kbit/s according to CDMA2000 Rate Set II).

Figure 5:
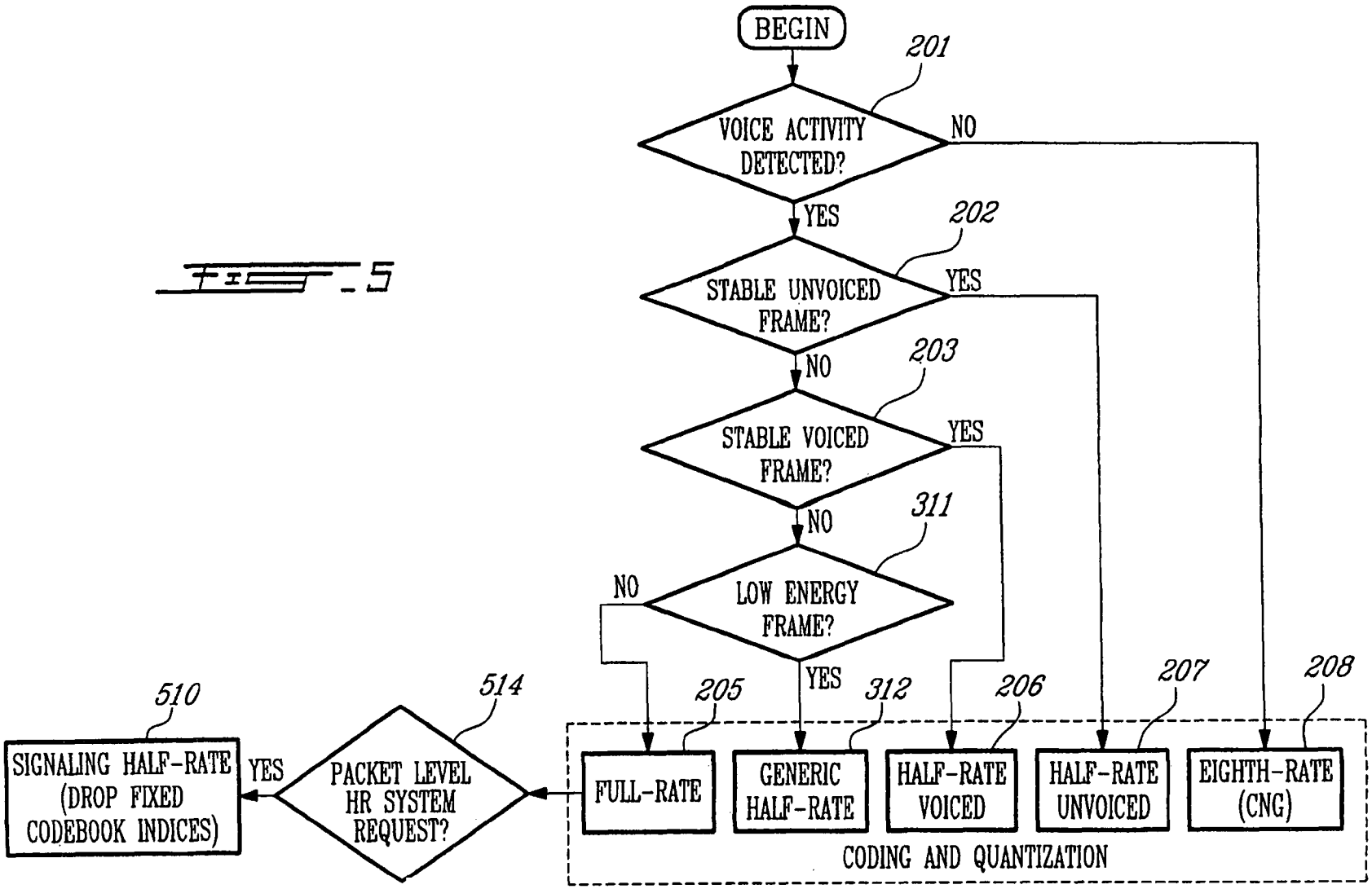
FIG. 5 is a functional block diagram of an example of variable bit rate codec in accordance with the non-restrictive illustrative embodiment of the present invention, including a half-rate system request on the packet level (or bitstream level) within the rate determination logic.

In the non-restrictive illustrative embodiment of the present invention as shown in FIG. 5, the rate determination logic and variable rate coding are the same as in FIG. 3. However, after the frame has been coded and the bits are transmitted, a test is performed to verify if the system requests a half-rate operation in module 514. If this is the case and the transmitted frame is a FR frame then a portion of the signal-coding parameters, for example the fixed codebook indices are dropped in order to obtain a signaling half-rate frame (module 510). Note that in this non-restrictive illustrative embodiment, one to three bits are used for the half-rate mode (Generic, Voiced, Unvoiced, or Interoperable). Thus, the 3 bits indicating a Signaling or Interoperable half-rate are added after the portion of the signal-coding parameters (fixed codebook indices) are dropped. The bits in the frame are distributed according to Table 5.

The choice of dropping the fixed codebook indices is due to the fact that these bits are the least sensitive to errors, and generating them at random has small impact on the performance. However, it should be kept in mind that other bits can be dropped to obtain Interoperable or signaling half-rate without loss of generality.

In this non-restrictive illustrative embodiment, in Signaling or Interoperable half-rate operation at the coder side, the coder operates as a full-rate coder. The fixed codebook search is performed as usual and the determined fixed codebook excitation is used in updating the adaptive codebook content and filter memories for next frames according to AMR-WB standard at 12.65 kbit/s [ITU-T Recommendation G.722.2 "Wideband coding of speech at around 16 kbit/s using Adaptive Multi-Rate Wideband (AMR-WB)", Geneva, 2002] [3GPP TS 26.190, "AMR Wideband Speech Codec: Transcoding Functions,"3GPP Technical Specification]. Therefore, no random codebook indices are used within the coder operation. This is evident in the implementation of FIG. 5 where the half-rate system request (module 514) is verified after the frame has been encoded in normal full-rate operation.

In Signaling or Interoperable half-rate operation at the decoder side, the dropped portion of the signal-coding parameters, for example the indices of the fixed codebook are randomly generated. The decoder then operates as in full-rate operation: Other methods for generating the dropped portion of the signal-coding parameters can be used. For instance, the dropped parameters can be obtained by copying parts of the received bitstream. Note that a mismatch can happen between the memories at the coder and decoder sides, since the dropped portion of the signal-coding parameters, for example the fixed codebook excitation is not the same. However, such mismatch does not appear to influence the performance especially in case of dim-and-burst signaling when interoperating between CDMA2000 VBR and AMR-WB, where typical rates are around 2%.

The performance of the proposed approach in dim-and-burst operation is almost transparent compared to the case where there is no half-rate system request. In many cases, the rate determination logic already determines the frame to be encoded with either eighth rate, quarter rate, or half-rate (Generic, Voiced, or Unvoiced). In such a case, the half-rate system request is neglected since it is already accommodated by the coder and the type of signal in the frame is suitable for encoding at a half-rate or a lower rate.

It should be noted that the classification logic is adaptive with a mode of operation. Therefore in order to improve the performance, in the half-rate-max mode and dim-and-burst signaling, this classification logic can be made more relaxed for using the specific half-rate codecs (the half-rate voiced and unvoiced are used relatively more often than in normal operation). This is a sort of extension to the multi-mode operation, where the classification logic is more relaxed and modes with lower average data rates are used.

Tandem Free Operation Between CDMA2000 System and Other Systems Using the AMR-WB Standard As mentioned earlier, designing a Variable Bit Rate Wide-Band (VBR-WB) codec for the CDMA2000 system based on the AMR-WB codec has the advantage of enabling Tandem Free Operation (TFO), or packet-switched operation, between the CDMA2000 system and other systems using the AMR-WB standard (such as the mobile GSM system or W-CDMA third generation wireless system). However, in a cross-system tandem free operation call between CDMA2000 and another system using AMR-WB, the CDMA2000 system may force the use of the half-rate as explained earlier (such as in dim-and-burst signaling). Since the AMR-WB codec doesn't recognize the 6.2 kbit/s half-rate of the CDMA2000 wideband codec, then forced half-rate frames is interpreted as erased frames. This degrades the performance of the connection. The use of the interoperable half-rate mode disclosed earlier will significantly improve the performance since this mode can interoperate with the 12.65 kbit/s rate of the AMR-WB standard.

As disclosed herein above, the interoperable half-rate is basically a pseudo full-rate, where the codec operates as if it is in the full-rate mode. The difference is that a portion of the signal-coding parameters, for example the algebraic codebook indices are dropped at the end and are not transmitted. At the decoder side, the dropped portion of the signal-coding parameters, for example the algebraic codebook indices are randomly generated and then the decoder operates as if it is in a full-rate mode.

Figure 6:
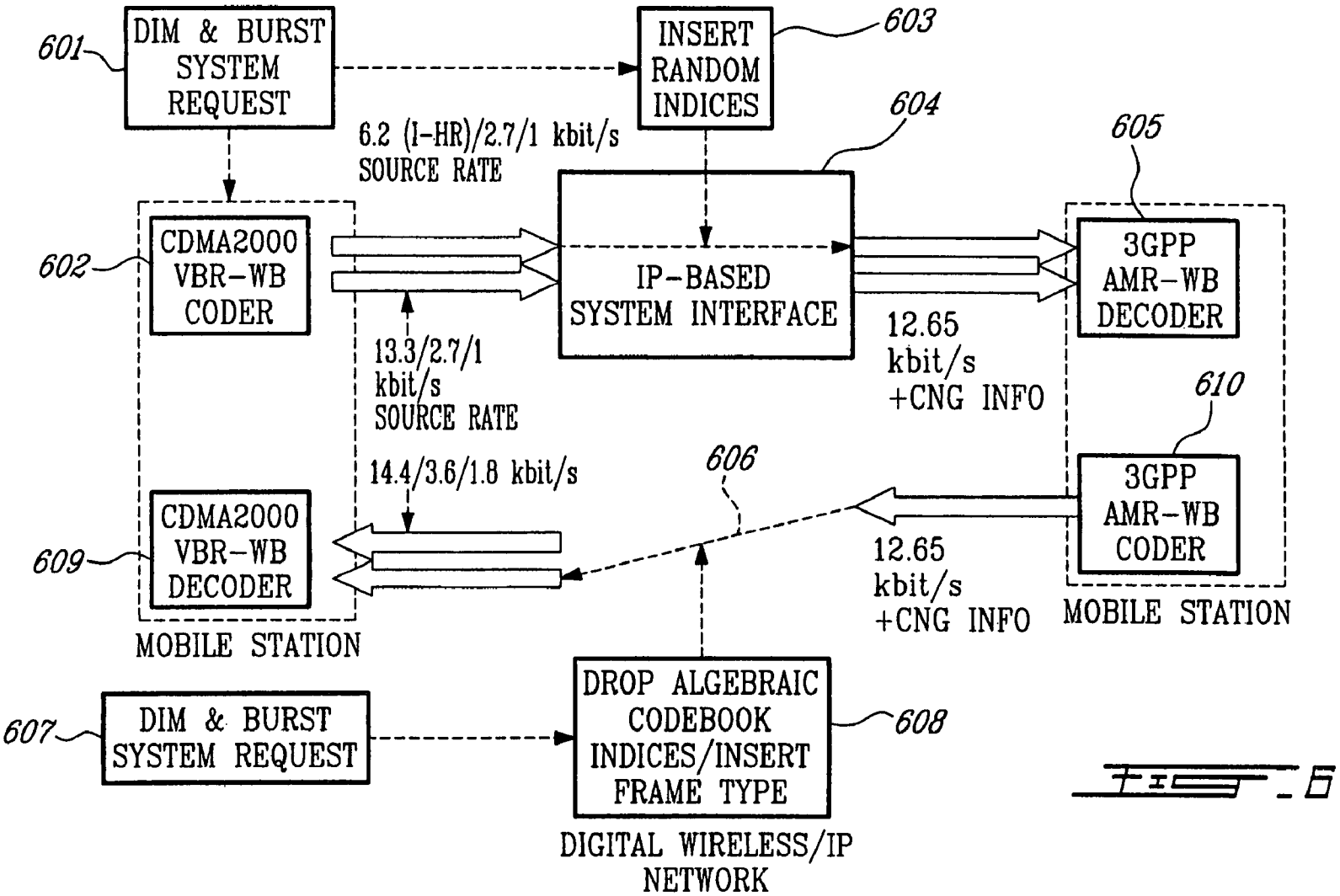
FIG. 6 is an example configuration for a dim and burst signaling method in accordance with the non-restrictive illustrative embodiment of the present inventions in the interoperable mode of VBR-WB when involved in a 3GPP⇆CDMA2000 mobile to mobile call or AMR-WB⇆VBR-WB IP call.

FIG. 6 illustrates a configuration according to the non-restrictive, illustrative embodiment of the present invention, demonstrating the use of the interoperable half-rate mode during in-band transmission of signaling information (i.e., dim and burst condition) in CDMA2000 system side. In this figure, the other side is a system using the AMR-WB standard and a 3GPP wireless system is given as an example.

In the link with the direction from CDMA2000 to 3GPP or other system using AMR-WB, when the multiplex sub-layer indicates a request for half-rate mode (see dim-and-burst system request 601), the VBR-WB coder 602 will operate in the Interoperable Half Rate (I-HR) described earlier. At the system interface 604, when an I-HR frame is received, randomly generated algebraic codebook indices are inserted by the module 603 in the bit stream through the IP-based system interface 604 to output a 12.65 kbit/s rate. The decoder 605 at the 3GPP side will interpret it as an ordinary 12.65 kbit/s frame.

In the other opposite direction, that is in a link from 3GPP or other system using AMR-WB to CDMA2000, if at the system interface 606 a half-rate request (see dim-and-burst system request 607) is received, then a module 608 drops the algebraic codebook indices and inserts 3 bits indicating the I-HR frame type. The decoder 609 at the CDMA2000 side will operate as an I-HR frame type, which is part of the VBR-WB solution.

This proposal requires a minimal logic at the system interface and it significantly improves the performance over forcing dim-and-burst frames as blank-and-burst frames (erased frames).

Another issue in interoperation is handling of background noise frames. On the AMR-WB side, the coder 610 supports DTX (discontinuous transmission) and CNG (comfort noise generation) operation. Inactive speech frames (silence or background noise) are either encoded as SID (silence description) frames using 35 bits or they are not transmitted (no-data). On the CDMA2000 side, inactive speech frames are coded using Eighth Rate (ER). Since the 35 bits for SID cannot be sent using ER, a CNG quarter rate (QR) is used to send SID frames from AMR-WB side to CDMA2000 side. Non-transmitted no-data frames on the AMR-WB side are converted into ER frames (all bits are set to 1 in the illustrative embodiment). On the CDMA2000 side in the Interoperable mode, ER frames are treated by the decoder as frame erasures.

In the interoperation from CDMA2000 to AMR-WB side, in the beginning of inactive speech segments, CNG QR is used, then ER frames are used. In the non-restrictive illustrative embodiment of the invention, the operation is similar to the VAD/DTX/CNG operation in AMR-WB where a SID frame is sent once every eight frames. In this case, the first inactive speech frame is encoded as CNG QR frame and the following 7 frames are encoded as ER frames. At the system interface, CNG QR frames are converted into AMR-WB SID frames and ER frames are not transmitted (no-data frames).

The bit allocation of CNG QR and CNG ER frames is shown in Table 6.

TABLE 6

Bit allocation of the CNG QR at 2.7 kbit/s and CNG ER at 1 kbit/s for a 20-ms frame.

| | Bits per Frame | |
|---|---|---|
| Parameter | CNG QR | CNG ER |
| Class Info | 1 | — |
| LP Parameters | 28 | 14 |
| Gains | 6 | 6 |
| Unused bits | 19 | — |
| Total | 54 | 20 |

Although the present invention has been described in the foregoing description in relation to a non-restrictive illustrative embodiment thereof, this illustrative embodiment can be modified as will, within the scope of the appended claims without departing from the scope and spirit of the subject invention. As an example, bits other that those related to the fixed codebook indices, in particular bits with less bit error sensitivity, can be dropped in order to obtain an interoperable half-rate frame.

What is claimed is:

1. A method comprising:

receiving a frame using a second communication mode of a first communication scheme, wherein the frame comprises information and a second portion of signal-coding parameters, wherein the information indicates that the frame is encoded in accordance with a particular communication mode that involves dropping a first portion of the signal-coding parameters instead of a first communication mode of the first communication scheme to reduce bit rate during transmission of said frame, wherein the particular communication mode comprises a signaling half rate communication mode or an interoperable half rate communication mode, wherein the first communication mode of the first communication scheme is a full-rate communication mode and the second communication mode of the first communication scheme is a half-rate communication mode;

in response to said information, generating replacement signal-coding parameters to replace the first portion of the signal-coding parameters dropped to reduce the bit rate during transmission of the frame;

inserting the generated replacement signal-coding parameters into the received frame to enable further transmission of the frame in accordance with the first communication mode of the first communication, wherein the first communication mode of the first communication scheme is interoperable with a communication mode of a second communication scheme and the second communication mode of the first communication scheme is not interoperable with the communication mode of the second communication scheme; and further transmitting the frame using the communication mode of the second communication scheme, wherein a first system uses the first communication scheme and a second system uses the second communication scheme, wherein the method enables interoperation between the first system and the second system, wherein the first system is a code division multiple access 2000 (CDMA2000) system using a variable bit rate wideband (VBR-WB) codec and the second communication system is a third generation partnership project (3GPP) system using an adaptive multi-rate-wideband (AMR-WB) codec.

2. A method comprising:

receiving signal-coding parameters representative of a sound signal encoded in accordance with a full-rate communication mode of a CDMA2000 VBR-WB communication scheme;

receiving a request to transmit the signal-coding parameters using a half-rate communication mode of the CDMA2000 VBR-WB communication scheme to reduce bit rate during transmission of said signal-coding parameters; and in response to the request, dropping a portion of the signal-coding parameters to enable transmission of the remaining signal-coding parameters using the half-rate communication mode of the CDMA2000 VBR-WB communication scheme, wherein the dropped portion of the signal-coding parameters are fixed codebook indices of an algebraic codebook, and wherein, when the dropped portion of the signal-coding parameters are replaced with replacement signal-coding parameters, the remaining signal coding parameters are capable of being decoded with a communication mode of a 3GPP AMR-WB communication scheme.

3. The method as defined in claim 2, further comprising inserting an identification of the communication mode to be transmitted along with the remaining signal-coding parameters.

4. The method as defined in claim 2, further comprising:

generating the replacement signal-coding parameters to replace the dropped fixed codebook indices.

5. The method as defined in claim 4, wherein generating the replacement signal-coding parameters comprises randomly regenerating the fixed codebook indices.

6. A method as defined in claim 2, further comprising:

transmitting the remaining signal-coding parameters using the half-rate communication mode of the CDMA2000 VBR-WB communication scheme;

generating the replacement signal-coding parameters to replace the dropped portion of the signal-coding parameters; and decoding the signal-coding parameters including the replaced portion of the signal-coding parameters according to a full-rate communication mode of the 3GPP AMR-WB communication scheme.

7. The method as defined in claim 2, further comprising transmitting the remaining signal-coding parameters using the half-rate communication mode of the CDMA2000 VBR-WB communication scheme.

8. A method comprising:

receiving an indication that signal-coding parameters have been transmitted using a half-rate communication mode of a CDMA2000 VBR-WB communication scheme instead of a full-rate communication mode of the CDMA2000 VBR-WB communication scheme to reduce bit rate during transmission of said signal-coding parameters, wherein the signal-coding parameters are representative of a sound signal encoded according to the full-rate communication mode of the CDMA2000 VBR-WB communication scheme, wherein the signal coding parameters have had a portion of the signal coding parameters dropped to leave remaining signal coding parameters, and wherein the remaining signal coding parameters are capable of being decoded with a communication mode of a 3GPP AMR-WB communication scheme; and in response to said indication, generating replacement signal-coding parameters to replace the portion of the signal-coding parameters dropped, wherein the replacement signal coding parameters can be combined with the remaining signal coding parameters to produce a second signal-coding parameters according to a full-rate communication mode of a 3GPP AMR-WB communication scheme, wherein the dropped portion of the signal-coding parameters are fixed codebook indices of an algebraic codebook.

9. The method as defined in claim 8, further comprising receiving the remaining signal-coding parameters and decoding the sound signal using the second signal-coding parameters.

10. The method as defined in claim 8, further comprising transmitting the second signal coding parameters according to the full-rate communication mode of the 3GPP AMR-WB communication scheme.

11. A system comprising a first station using a CDMA2000 VBR-WB communication scheme and a second station using an AMR-WB communication scheme;

said first station comprising:

means for encoding a sound signal to generate signal-coding parameters according to a full-rate communication mode of the CDMA2000 VBR-WB communication scheme, means for receiving a request to transmit the signal-coding parameters using a half-rate communication mode of the CDMA2000 VBR-WB communication scheme, means for dropping, in response to said request, a portion of the signal-coding parameters encoded according to the full-rate communication mode of the CDMA2000 VBR-WB communication scheme, wherein the dropped portion of the signal-coding parameters are fixed codebook indices of an algebraic codebook, and means for transmitting the remaining signal-coding parameters using the half-rate communication mode of the CDMA2000 VBR-WB communication scheme;

said second station comprising:

means for receiving the remaining signal-coding parameters, means for generating replacement signal-coding parameters to replace said dropped portion of the signal-coding parameters, and means for decoding the signal-coding parameters using the remaining signal-coding parameters and the generated replacement signal-coding parameters.

12. A device comprising:

means for receiving signal-coding parameters representative of a sound signal encoded in accordance with a full-rate communication mode of a CDMA2000 VBR-WB communication scheme;

means for receiving a request to transmit the signal-coding parameters using a half-rate communication mode of the CDMA2000 VBR-WB communication scheme to reduce bit rate during transmission of said signal-coding parameters;

means for dropping a portion of the signal-coding parameters to enable transmission of the remaining signal-coding parameters using the half-rate communication mode of the CDMA2000 VBR-WB communication scheme, wherein the dropped portion of the signal-coding parameters are fixed codebook indices of an algebraic codebook, and wherein, when the dropped portion of the signal-coding parameters are replaced with replacement signal-coding parameters, the remaining signal coding parameters are capable of being decoded with a communication mode of a 3GPP AMR-WB communication scheme; and means for transmitting the remaining signal-coding parameters according to the half-rate communication mode of the CDMA2000 VBR-WB communication scheme.

13. The device as defined in claim 12, wherein:

the means for dropping a portion of the signal-coding parameters is arranged to insert an identification of the communication mode to be transmitted along with the remaining signal-coding parameters.

14. A device comprising:

means for receiving an indication that signal-coding parameters have been transmitted using a half-rate communication mode of a CDMA2000 VBR-WB communication scheme instead of a full-rate communication mode of the CDMA2000 VBR-WB communication scheme to reduce bit rate during transmission of said signal-coding parameters, wherein the signal-coding parameters are representative of a sound signal, wherein the signal coding parameters have had a portion of the signal coding parameters dropped to leave remaining signal coding parameters, and wherein the remaining signal coding parameters are capable of being decoded with a communication mode of a 3GPP AMR-WB communication scheme; and means for generating, in response to said indication, replacement signal-coding parameters to replace the portion of the signal-coding parameters dropped, wherein the replacement signal coding parameters can be combined with the remaining signal coding parameters in order to produce second signal-coding parameters according to a full-rate communication mode of a 3GPP AMR-WB communication scheme, wherein the dropped portion of the signal-coding parameters are fixed codebook indices of an algebraic codebook.

15. The device as defined in claim 14, wherein the means for generating replacement signal-coding parameters is arranged to randomly generate replacement signal-coding parameters.

16. The device as defined in claim 15, wherein the randomly generated replacement signal-coding parameters comprise randomly generated replacement fixed codebook indices.

17. The device as defined in claim 16, further comprising means for transmitting the signal coding parameters including the replaced portion of the signal-coding parameters according to the full-rate communication mode of the 3GPP AMR-WB communication scheme.

18. The device as defined in claim 14, further comprising means for receiving the signal-coding parameters and means for decoding the sound signal using the second signal-coding parameters.

* * * * *